US011634867B2

(12) United States Patent
Oshima et al.

(10) Patent No.: US 11,634,867 B2
(45) Date of Patent: Apr. 25, 2023

(54) METHOD FOR PRODUCING PAPER

(71) Applicants: OSAKA UNIVERSITY, Suita (JP); DAIKIN INDUSTRIES, LTD., Osaka (JP)

(72) Inventors: Akihiro Oshima, Suita (JP); Yoshikage Ohmukai, Osaka (JP); Yuko Shiotani, Osaka (JP); Kazuyuki Satou, Osaka (JP); Michio Matsuda, Osaka (JP); Tomohiro Yoshida, Osaka (JP); Ikuo Yamamoto, Osaka (JP)

(73) Assignees: OSAKA UNIVERSITY, Osaka (JP); DAIKIN INDUSTRIES, LTD., Osaka (JP)

( * ) Notice: Subject to any disclaimer, the term of this patent is extended or adjusted under 35 U.S.C. 154(b) by 84 days.

(21) Appl. No.: 17/132,375

(22) Filed: Dec. 23, 2020

(65) Prior Publication Data

US 2021/0108371 A1 Apr. 15, 2021

Related U.S. Application Data

(63) Continuation of application No. PCT/JP2019/025890, filed on Jun. 28, 2019.

(30) Foreign Application Priority Data

Jun. 29, 2018 (JP) ..... JP2018-125353

(51) Int. Cl.
*D21H 19/20* (2006.01)
*D21H 21/16* (2006.01)
*D21H 27/10* (2006.01)

(52) U.S. Cl.
CPC ..... *D21H 19/20* (2013.01); *D21H 21/16* (2013.01); *D21H 27/10* (2013.01)

(58) Field of Classification Search
CPC ..... D21H 25/06; D21H 19/20; D21H 17/34; D21H 19/48; D21H 27/10; D21H 19/16; D21H 19/58; D21H 21/16
USPC ..... 162/136
See application file for complete search history.

(56) References Cited

U.S. PATENT DOCUMENTS

| | | | |
|---|---|---|---|
| 6,306,944 | B1 | 10/2001 | Seki |
| 6,335,060 | B1 | 1/2002 | Inoue |
| 2010/0018659 | A1 | 1/2010 | Hupfield et al. |

FOREIGN PATENT DOCUMENTS

| | | | |
|---|---|---|---|
| JP | 09-207248 | A | 8/1997 |
| JP | 11-286170 | A | 10/1999 |
| JP | 2000-220093 | A | 8/2000 |
| JP | 2000-334705 | A | 12/2000 |
| JP | 2005-059307 | A | 3/2005 |
| JP | 2009-544867 | A | 12/2009 |

OTHER PUBLICATIONS

JP 2005 059307, Nakamura Koici et al. Oct. 2005, machine translation.*
Extended European Search Report dated Feb. 16, 2022 from the European Patent Office in EP Application No. 19827106.6.
International Preliminary Report on Patentability with a translation of Written Opinion dated Jan. 7, 2021 from International Bureau in International Application No. PCT/JP2019/025890.
International Search Report for PCT/JP2019/025890, dated Aug. 6, 2019.

* cited by examiner

*Primary Examiner* — Mark Halpern
(74) *Attorney, Agent, or Firm* — Sughrue Mion, PLLC

(57) ABSTRACT

A method for producing a paper, which includes applying at least one of ionizing radiation and plasma to at least one of a paper base and a compound (A) selected from: a compound having a carbon-carbon unsaturated bond and containing no fluorine atom in a molecular structure, and a compound containing no fluorine atom in a molecular structure in which radicals are generated by irradiation of an electron beam to the compound, to introduce a layer formed from the compound (A) on a surface of the paper base.

17 Claims, No Drawings

METHOD FOR PRODUCING PAPER

This is a continuation application under 37 C.F.R. § 1.53(b) of International Application No. PCT/JP2019/025890 filed Jun. 28, 2019, which claims priority from Japanese Patent Application No. 2018-125353 filed Jun. 29, 2018. The above-noted applications are incorporated herein by reference in their respective entireties.

TECHNICAL FIELD

The present disclosure relates to a method for producing a paper.

BACKGROUND ART

Conventionally, a compound containing fluorine atoms has been used as a repellent agent used for papers, for example, in food packaging irradiations. However, responding to stricter environmental regulations, it may be required to use a compound containing no fluorine atom.

In Examples of Patent Literature 1, paper is made by using a pulp slurry containing a urethane acrylate emulsion as a radiation-curable resin, and printing, punching, pasting, and irradiation of radiation are then carried out to form a paper-made case.

CITATION LIST

Patent Literature

Patent Literature 1: JP.H09-207248 A

SUMMARY

The present disclosure provides the following [1] to [2].

[1] A method for producing a paper, wherein the method includes applying at least one of ionizing radiation and plasma to at least one of a paper base and a compound (A) selected from:

a compound having a carbon-carbon unsaturated bond and containing no fluorine atom in a molecular structure, and a compound containing no fluorine atom in a molecular structure in which radicals are generated by irradiation of an electron beam to the compound, to introduce a layer formed from the compound (A) on a surface of the paper base, wherein the compound (A) is at least one of compounds represented by the following formulae:

$$R^1(—R^{21}—)_m—R^1$$

$$CH_2{=}C(—R^1)—C(=O)—O—R^2,$$

$$CH_2{=}C(—R^1)—C(=O)—O—(CH_2)_m—OC(=O)—NH—R^2,$$

$$CH_2{=}C(—R^1)—C(=O)—O—(CH_2)_m—NH—C(=O)—R^3,$$

$$CH_2{=}C(—R^1)—C(=O)—O—(CH_2)_m—NH—C(=O)—NH—R^2,$$

$$CH_2{=}C(—R^1)—C(=O)—O—(CH_2)_m—NH—SO_2—R^2,$$

$$CH_2{=}C(—R^1)—C(=O)—O—R^4—C_6H_4—O—R^2,$$

$$CH_2{=}C(—R^1)—C(=O)—O—(CH_2CH_2O)_n—R^2$$

wherein:

$R^1$ is each independently at each occurrence a hydrogen atom, a $—CH_3$ group, or a chlorine atom;

$R^{21}$ is an alkylene group having 14 to 28 carbon atoms;

$R^2$ is each independently at each occurrence an alkyl group having 14 to 28 carbon atoms;

$R^3$ is each independently at each occurrence an alkyl group having 13 to 27 carbon atoms;

$R^4$ is each independently at each occurrence a single bond or an alkylene group having 1 to 20 carbon atoms;

m is an integer of 1 to 28; and n is an integer of 1 to 3.

[2] A paper including a layer formed on a surface thereon, wherein the layer comprises a graft chain formed from a compound (A) selected from:

a compound having a carbon-carbon unsaturated bond and containing no fluorine atom in a molecular structure, and a compound containing no fluorine atom in a molecular structure in which radicals are generated by irradiation of an electron beam to the compound, and the compound (A) is at least one of compounds represented by the following formulae:

$$R^1(—R^{21}—)_m—R^1$$

$$CH_2{=}C(—R^1)—C(=O)—O—R^2,$$

$$CH_2{=}C(—R^1)—C(=O)—O—(CH_2)_m—OC(=O)—NH—R^2,$$

$$CH_2{=}C(—R^1)—C(=O)—O—(CH_2)_m—NH—C(=O)—R^3,$$

$$CH_2{=}C(—R^1)—C(=O)—O—(CH_2)_m—NH—C(=O)—NH—R^2,$$

$$CH_2{=}C(—R^1)—C(=O)—O—(CH_2)_m—NH—SO_2—R^2,$$

$$CH_2{=}C(—R^1)—C(=O)—O—R^4—C_6H_4—O—R^2,$$

$$CH_2{=}C(—R^1)—C(=O)—O—(CH_2CH_2O)_n—R^2$$

wherein:

$R^1$ is each independently at each occurrence a hydrogen atom, a $—CH_3$ group, or a chlorine atom;

$R^{21}$ is an alkylene group having 14 to 28 carbon atoms;

$R^2$ is each independently at each occurrence an alkyl group having 14 to 28 carbon atoms;

$R^3$ is each independently at each occurrence an alkyl group having 13 to 27 carbon atoms;

$R^4$ is each independently at each occurrence a single bond or an alkylene group having 1 to 20 carbon atoms;

m is an integer of 1 to 28; and n is an integer of 1 to 3.

Advantageous Effects

The present disclosure can provide a method for producing a paper having good oil resistance and good air permeability, wherein a compound having no fluorine atom is used as a treatment agent for the paper.

DESCRIPTION OF EMBODIMENTS

Hereinafter, a production method of the present disclosure will be described.

A method for producing a paper of the present disclosure includes applying at least one of ionizing radiation and plasma to at least one of a paper base and a compound (A), wherein the compound (A) is selected from a compound having a carbon-carbon unsaturated bond and containing no fluorine atom in a molecular structure, and a compound containing no fluorine atom in a molecular structure in which radicals are generated by irradiation of an electron beam to the compound, to introduce a layer formed from the compound on a surface of the paper base via a physical bond and/or a chemical bond. Hereinafter, "the compound (A) is selected from a compound having a carbon-carbon unsaturated bond and containing no fluorine atom in a molecular structure, and a compound containing no fluorine atom in a molecular structure in which radicals are generated by irradiation of an electron beam to the compound" may be referred to as "compound (A)".

Herein, the paper base means a base composed of a paper subjected to introduction of the layer derived from the compound (A) of the present disclosure, for example, introduction of molecular chains having the compound (A) as a constituent unit. In the present disclosure, the "paper" refers to one produced by agglutinating plant fibers or other fibers, one produced by blending plant fibers or other fibers and fibers composed of a synthetic high-molecular substance, one produced by using a synthetic high-molecular substance, and one including a fibrous inorganic material.

In the present disclosure, for example, those having flex resistance, rigidity, strength and the like can be used as the paper base. The paper base is not limited, and for example, a raw paper for a food case, i.e., a paper composed of one which can be used a food packaging or a food case can be used.

Specific examples of the paper include kraft paper, high-quality paper, medium-quality paper, recycled paper, lightweight coated paper, coated paper, one-sided glazed paper, semiglassine paper, glassine paper, parchment paper, Japanese paper, and cardboard.

The density of the paper base is not limited. For example, it is within a range of 0.3 to 1.1 g/cm$^3$, and may be within a range of 0.3 to 0.8 g/cm$^3$.

The ionizing radiation used is one which is applied to at least one of the paper base and the compound (A) to allow intermediate active species such as radicals, radical cations, or radical anions to be generated in the at least one of the paper base and the compound (A). Thus, the intermediate active species are formed, whereby the layer formed from the compound (A) can be introduced on the surface of the paper base. Specifically, the intermediate active species as described above are formed, whereby, for example, the molecular chains having the constituent unit derived from the compound (A) can be introduced on the surface of the paper base.

Examples of the ionizing radiation include α-ray, electron beam ($\beta^-$ray), positive electron beam ($\beta^+$ray), ultraviolet ray having a wavelength of 450 nm or less including extreme ultraviolet light, γ-ray, neutron ray, X-ray, and positive or negative ions accelerated by an electric field. Electrons, positive electrons, and ions accelerated by an electric field are preferably used because they provide easy control of a penetration depth (range) or easy formation of the intermediate active species. In particular, an electron beam by means of an electron accelerator is preferably used.

Examples of the plasma include atmospheric-pressure plasmas of nitrogen, oxygen, and argon in addition to plasmas of hydrogen, helium, nitrogen, oxygen, argon, neon, and a carbon derivative under reduced pressure.

In one embodiment, as the ionizing radiation and the plasma, at least one of an α-ray, an electron beam (β-ray), a γ-ray, a neutron ray, an X-ray, and plasma is preferably used, and at least one of an electron beam (β-ray) and plasma is more preferably used.

In one embodiment, as the ionizing radiation and the plasma, an α-ray, an electron beam (β-ray), a γ-ray, a neutron ray, an X-ray, or plasma is preferably used, and an electron beam (β-ray) or plasma is more preferably used.

Irradiation of the ionizing radiation or the plasma to the paper base may be carried out in an atmospheric environment, and from the viewpoint of suppressing oxidative deterioration of the paper base and pair annihilation of produced intermediate active species, the irradiation may be carried out at a low oxygen concentration of 10% or less, preferably under an atmosphere where substantially no oxygen is present, for example, where the oxygen concentration is 1,000 ppm or less, more preferably 500 ppm, and still more preferably 100 ppm or less. For example, the irradiation of the ionizing radiation is carried out in vacuum or under an atmosphere of an inert gas such as under nitrogen, argon or helium atmosphere. The vacuum is not necessarily perfect vacuum and just needs to be a substantial vacuum. For example, it may be any of a reduced pressure environment of approximately $10^3$ Pa, a low vacuum of approximately $10^{-1}$ Pa, and a high vacuum not more than that.

The absorbed dose of the ionizing radiation to be applied to the paper is preferably 5 kGy or more, more preferably 20 kGy or more, and still more preferably 50 kGy or more; preferably 250 kGy or less, more preferably 200 kGy or less, and still more preferably less than 150 kGy. The absorbed dose of the ionizing radiation to be applied is preferably 5 to 250 kGy, more preferably 20 to 200 kGy, and still more preferably 50 kGy or more and less than 150 kGy. Irradiation of the ionizing radiation at an absorbed dose in the above numerical range can suppress a change in material properties of a paper medium (for example, deterioration) due to the irradiation of the ionizing radiation, whereby production of a sufficient amount of intermediate active species and chemical reaction due to the intermediate active species can be allowed. The amount of energy irradiation to the paper base (irradiation dose) can be measured with a Faraday cup, a scintillation detector, or a semiconductor detector. The amount of energy absorption (absorbed dose) of the paper base can be measured with a Fricke dosimeter, and simply, it can be measured with, for example, a cellulose triacetate film (CTA: cellulose triacetate) dosimeter, and a radiochromic film dosimeter.

When the electron beam is used, an electron accelerator is used, and in particular, an electrostatic accelerator which can have a high electron flow density is preferably used in terms of a processing speed. The electron energy of the electron beam to be applied to the paper base is preferably 2 MeV or less, more preferably 1 MeV or less, still more preferably 300 keV or less, particularly preferably 250 keV or less, and yet still more preferably less than 200 keV; preferably 40 keV or more, and more preferably 70 keV or more at the surface of the paper base. Irradiation of the above amount of energy can suppress a change in the characteristics of the paper base (for example, deterioration of cellulose fibers due to radiation), whereby the compound (A) can be introduced on the paper base. Specifically, a sufficient amount of intermediate active species for graft polymerization in the paper base can be produced.

In the case of an electron accelerator without any irradiation window such as a titanium foil due to a system configuration such as differential pumping, if a space between an electron source and the paper base is under a reduced pressure of 1 Pa or less or under a vacuum environment, the electron energy generally corresponds to the accelerating voltage. For example, in the case of irradiation of the ionizing radiation to a single-layer of paper, the accelerating voltage is preferably at most 10 MV, more preferably 5 MV or less, still more preferably 800 kV or less, yet still more preferably 300 kV or less. Furthermore, in the case of irradiation of the ionizing radiation to multiple-layer of paper which is stacked, attenuation of electron energy occurs in each layer, so that the electron energy and the accelerating voltage do not correspond to each other, which makes it necessary to select the accelerating voltage depending on the electron energy in each layer.

On the other hand, in the case of an electron accelerator, which has an irradiation window for extraction into the atmosphere (such as titanium foil) between an electron gun and a sample (that is, the paper base), even when the irradiation is carried out in vacuum, the electron energy is attenuated upon passing through the irradiation window. Even when the irradiation environment is under an atmosphere of an inert gas such as nitrogen, argon, or helium, energy loss of electrons occurs in the inert gas, and therefore, the energy at the surface of the paper base varies depending on a distance from the electron extraction window to the single-layer paper base. For example, when electrons pass through nitrogen gas stream as well, the energy needs to be increased considering attenuation depending on the density of the gas stream and the distance to the paper base. Furthermore, in the case of irradiation of the ionizing radiation to multiple-layer which is stacked, attenuation of electron energy occurs in each layer, which makes it necessary to select the accelerating voltage depending on the electron energy in each layer.

The irradiation of the ionizing radiation to the paper base may be carried out once or multiple times.

In the irradiation of the ionizing radiation to the paper base, the ionizing radiation may be applied to paper sheets one by one, or applied to multiple sheets stacked. In this case, it is necessary to consider the selection of the acceleration energy.

A temperature during the irradiation of the ionizing radiation is not limited, and it is, for example, 150° C. or less, preferably 10° C. to 100° C., and more preferably 20° C. to 80° C.

The paper base after the irradiation of the ionizing radiation may be heated as necessary. Heating can improve the oil resistance of the paper obtained by changing the morphology of the compound (A) after the introduction of the layer on the paper base (for example, after grafting).

The irradiation of the plasma may be carried out by a low-pressure plasma treatment, an atmospheric-pressure plasma treatment, a corona discharge, and an arc discharge.

The irradiation of the plasma to the paper base may be carried out once or multiple times.

Examples of discharge gases in the irradiation of the plasma include hydrogen, helium, nitrogen, oxygen, argon, neon, and a carbon derivative.

The output of a plasma source in the atmospheric-pressure plasma treatment may be 10 to 1,000 W or 50 to 300 W. A treatment temperature is not limited, and it is, for example, 150° C. or less, preferably 10° C. to 100° C., and more preferably 20° C. to 80° C. A treatment time may be, for example, 10 to 300 seconds.

Electric power discharged between electrodes in the low-pressure plasma treatment may be 10 to 1,000 W or 50 to 300 W. A treatment temperature is not limited, and it is, for example, 150° C. or lower, preferably 10° C. to 100° C., and more preferably 20° C. to 80° C. A treatment time may be, for example, 10 to 300 seconds.

By irradiating at least one of the ionizing radiation and the plasma to the paper base as described above, oil resistance can be imparted to the paper base.

In one embodiment, by irradiating at least one of the ionizing radiation and the plasma to the paper base, the intermediate active species such as radicals, radical cations, or radical anions can be generated in the paper base, and by subjecting the intermediate active species and the compound (A) to a heat reaction, a chemical bond is formed between the paper base and the compound (A), whereby a layer formed from graft chains having the compound (A) as a constituent unit can be introduced on the surface of the paper base.

In one embodiment, to a paper base integrated physically with the compound (A) which is coated by a method such as coating, at least one of the ionizing radiation and plasma are irradiated, then intermediate active species such as radicals, radical cations, or radical anions are induced. The intermediate active species are subjected to a chemical reaction between the paper base and the compound (A) to form a chemical bond between the paper base and the compound (A). This makes it possible to introduce the layer formed from the graft chains having the compound (A) as a constituent unit on the surface of the paper base.

In one embodiment, the compound (A) is radiation polymerized by irradiating at least one of the ionizing radiation and the plasma to the compound (A). The polymer is coated on the paper base by a method such as coating, whereby a layer formed from a compound (B) having the compound (A) as a constituent unit is physically bonded to the surface of the paper base. Thus, the layer formed from the compound (B) can be introduced on the paper base. The paper base after a coat treatment may be heated. By heating, the morphology of the compound (B) is changed, whereby adhesiveness between the compound (B) and the cellulose fiber included in the paper base can be improved. In particular, after the coat treatment, at least one of the ionizing radiation and the plasma may be irradiated to the paper base. By the irradiation, the chemical bond between the paper base and the compound (B) can be formed. As a result, the layer composed of the molecular chains formed from the compound (B) having the compound (A) as a constituent unit can be introduced on the surface of the paper base via the chemical bond.

In one embodiment, the compound (A) is polymerized, for example, using a catalyst, and the polymer is coated on the paper base by a method such as coating to physically bond a layer formed from a compound (C) having the compound (A) as a constituent unit to the surface of the paper base. Thus, the layer formed from the compound (C) is introduced on the paper base. The paper base after the coat treatment may be heated. By heating, the morphology of the compound (C) is changed, whereby adhesiveness between the compound (C) and the cellulose fiber included in the paper base can be improved. At least one of the ionizing radiation and the plasma is irradiated to the paper base after the coat treatment. By the irradiation, a chemical bond between the paper base and the compound (C) can be formed. As a result, a layer composed of molecular chains formed from the compound (C) having the compound (A) as a constituent unit can be introduced on the surface of the paper base via the chemical bond. It is considered that, by the irradiation as described above, the compound (C) coated on the surface of the paper base is shrunk, which makes it possible to impart not only oil resistance but also air permeability to the paper base.

Usually, gaps of the paper base serve as a passage for a gas which permeates through the paper base, to cause the gas to permeate through the paper base. As the surface treatment of the base material, a polymer polymerized in advance may be prepared, followed by forming a layer of the polymer on the surface of the paper base by a method such as coating. However, when the layer is formed on the surface of the paper base using the polymer polymerized in advance as described above, the air permeance of the formed paper may not have a good value even if the oil resistance on the surface of the paper is good. This is considered to be because, when the layer of the polymer polymerized in advance is formed by using a method such as coating, the polymer is present so as to cover the surface of the paper base, to block the gaps as a passage for a gas.

On the other hand, when the production method of the present disclosure is used, not only the oil resistance of the paper to be obtained but also the air permeance thereof can have a good value. This is considered to be because, in the production method of the present disclosure, the graft chains having a constituent unit derived from the compound (A) are introduced on the surface of the paper base, which is less likely to block the gaps as a passage for a gas as described above.

In particular, in an embodiment in which the molecular chains having the compound (A) as a constituent unit are present on the surface of the paper base (preferably, the compound (A) is brought into contact with the surface of the paper base, and more specifically, the compound (A) is coated on the surface of the paper base), even if the gaps serving as a passage for a gas are present in the paper base, the compound (A) having oil-repellency is present at least on the surface of the paper base (specifically, the compound (A) is coated on the paper base), which makes it possible to prevent the penetration of oil into the paper base. Therefore, according to the present embodiment, both the oil resistance and air permeance of the paper to be obtained are considered to be particularly good.

In the present disclosure, the compound (A) is preferably present at least on the surface of the paper base. By irradiating at least one of the ionizing radiation and the plasma in a state where the compound (A) is present on the surface of the paper base, a layer formed from the compound (A) is easily introduced on the surface of the paper base.

As one example, when graft polymerization may be produced by irradiating at least one of the ionizing radiation and the plasma, graft chains having a constituent unit derived from the compound (A) are easily introduced by irradiating at least one of the ionizing radiation and the plasma in a state where the compound (A) is present on the surface of the paper base.

According to one embodiment, molecular chains having the compound (A) as a constituent unit are preferably present at least on the surface of the paper base. By irradiating at least one of the ionizing radiation and the plasma in a state where the compound (A) is present on the surface of the paper base, a layer formed from the molecular chains having the compound (A) as a constituent unit is easily introduced on the surface of the paper base.

The compound (A) may be present at least on the surface of the paper base, and partially penetrate into the paper base.

A production method of the present disclosure preferably includes bringing a solution containing the compound (A) and the paper into contract with each other.

The contact can be provided by coating or spraying the solution containing the compound (A) on the paper base, or immersing the paper base in the solution. The contact may be provided by placing the paper base under the atmosphere of the compound (A) which is in a gas state. A method for coating the solution containing the compound (A) on the paper base is preferable because it can uniformly and surely provide the contact.

The contact may be provided once or multiple times.

From the viewpoints of productivity, cost and the like, the contact may be provided once.

From the viewpoint of improvement in oil resistance, the contact may be provided multiple times, or may be provided two to three times.

After the contact, the paper base brought into contact with the solution containing the compound (A) is preferably dried. When a solvent to be described later, or the like is contained in the solution containing the compound (A), the solvent or the like can be removed by drying. Here, "drying" includes not only complete removal of the solvent but also partial removal of the solvent such as semi-drying. The drying may be air-drying, or may be carried out by heating if necessary.

It is preferable that, when the contact is provided multiple times, drying be carried out after the contact, and contact and drying are then repeatedly carried out again.

The solution containing the compound (A) preferably contains 0.5 parts by mass or more of the compound (A) per 100 parts by mass of the solution, and more preferably contains 1 part by mass or more of the compound (A); preferably 20 parts by mass or less of the compound (A), and more preferably 10 parts by mass or less of the compound (A). The solution containing the compound (A) preferably contains 0.5 to 20 parts by mass of the compound (A) per 100 parts by mass of the solution, and more preferably contains 1 to 10 parts by mass of the compound (A). If the concentration of the compound (A) in the solution is too high, the viscosity of the solution is high, which may cause the solution to be unevenly distributed on the surface of the paper base. In such a case, the gaps of the paper base may be blocked, which may cause a decrease in air permeance of the paper formed. If the concentration of the compound (A) in the solution is too low, the fiber gaps of the surface of the paper base cannot sufficiently be filled, which may lead to a decrease in oil resistance on the surface of the paper formed.

The compound (A) is a compound having a carbon-carbon unsaturated bond and containing no fluorine atom in a molecular structure, or a compound containing no fluorine atom in a molecular structure in which radicals are generated by irradiation of an electron beam to the compound. Examples of the carbon-carbon unsaturated bond include a carbon-carbon double bond and a carbon-carbon triple bond. The compound (A) preferably has a carbon-carbon double bond.

As the compound (A), a hydrophobic compound is preferably used. The use of such a compound (A) can provide good water-repellency, oil-repellency, and liquid repellency of the surface of the paper formed by the production method of the present disclosure. A homopolymer of the compound (A) is coated on a silicon wafer, and a contact angle of water on the surface of the formed film is measured. When the contact angle is 70 degrees or more, the paper is determined to be hydrophobic.

The compound (A) is at least one of compounds represented by the following formulae.

$R^1(—R^{21}—)_m—R^1$ $CH_2=C(—R^1)—C(=O)—O—R^2$, $CH_2=C(—R^1)—C(=O)—O—(CH_2)_m—OC(=O)—NH—R^2$, $CH_2=C(—R^1)—C(=O)—O—(CH_2)_m—NH—C(=O)—R^3$, $CH_2=C(—R^1)—C(=O)—O—(CH_2)_m—NH—C(=O)—NH—R^2$, $CH_2=C(—R^1)—C(=O)—O—(CH_2)_m—NH—SO_2—R^2$, $CH_2=C(—R^1)—C(=O)—O—R^4—C_6H_4—O—R^2$, $CH_2=C(—R^1)—C(=O)—O—(CH_2CH_2O)_n—R^2$

These compounds may be used singly or in combination of two or more.

In the formulae, $R^1$ is each independently at each occurrence a hydrogen atom, a $—CH_3$ group, or a chlorine atom, preferably a $—CH_3$ group or a hydrogen atom, and more preferably a hydrogen atom.

In the formula, $R^{21}$ is an alkylene group having 14 to 28 carbon atoms at each occurrence, more preferably an alkylene group having 27 or less carbon atoms, and particularly preferably an alkylene group having 26 or less carbon atoms; preferably an alkylene group having 14 or more carbon atoms, more preferably an alkylene group having 16 or more carbon atoms, and still more preferably an alkylene group having 18 or more carbon atoms. The above $R^{21}$ is preferably an alkylene group having 14 to 28 carbon atoms, more preferably an alkylene group having 16 to 27 carbon atoms, and still more preferably an alkylene group having 18 to 26 carbon atoms.

A compound represented by the formula including the above $R^{21}$ generates radicals when an electron beam is irradiated to the compound, whereby the compound can be covalently bonded to the paper base. The compound has the above $R^{21}$, whereby hydrophobicity can be imparted to the paper base.

In the formulae, $R^2$ is each independently at each occurrence an alkyl group having 14 to 28 carbon atoms, preferably an alkyl group having 27 or less carbon atoms, and more preferably an alkyl group having 26 or less carbon atoms; preferably an alkyl group having 14 or more carbon atoms, more preferably an alkyl group having 16 or more carbon atoms, and still more preferably an alkyl group having 18 or more carbon atoms. The above $R^2$ is preferably an alkyl group having 14 to 28 carbon atoms, more preferably an alkyl group having 16 to 27 carbon atoms, and still more preferably an alkyl group having 18 to 26 carbon atoms.

It is considered that, if it has fewer carbon atoms, the graft chains cannot have crystallinity, so that sufficient oil resistance cannot be imparted to the paper. If it has too many carbon atoms, the compound (A) has a higher melting point, and may make its solution less handleable in the coating process. It is considered that, if it has too many carbon atoms, the motility of a monomer is reduced when ionizing radiation or plasma (specifically, an electron beam) is irradiated to make the monomer less polymerizable, so that the graft chains do not sufficiently grow.

In the formula, $R^3$ is each independently at each occurrence an alkyl group having 13 to 27 carbon atoms, preferably an alkyl group having 26 or less carbon atoms, and more preferably an alkyl group having 25 or less carbon atoms; preferably an alkyl group having 13 or more carbon atoms, more preferably an alkyl group having 15 or more carbon atoms, and still more preferably an alkyl group having 17 or more carbon atoms. The above $R^3$ is preferably an alkyl group having 13 to 27 carbon atoms, more preferably an alkyl group having 15 to 26 carbon atoms, and still more preferably an alkyl group having 17 to 25 carbon atoms.

In the formula, $R^4$ is each independently at each occurrence a single bond or an alkylene group having 1 to 20 carbon atoms, preferably an alkylene group having 1 to 4 carbon atoms, and more preferably an alkylene group having 2 to 3 carbon atoms.

In the formulae, m is an integer of 1 to 28, and preferably 2 to 4.

In the formulae, n is an integer of 1 to 3.

Specifically, the compound (A) is preferably any of the following compounds.

$CH_2=C(—R^1)—C(=O)—O—C_{22}H_{45}$, $CH_2=C(—R^1)—C(=O)—O—C_{18}H_{37}$, $CH_2=C(—R^1)—C(=O)—O—C_{16}H_{33}$, $CH_2=C(—R^1)—C(=O)—O—(CH_2)_2—OC(=O)—NH—C_{17}H_{37}$ $CH_2=C(—R^1)—C(=O)—O—(CH_2)_2—NH—(C=O)—C_{17}H_{35}$ $CH_2=C(—R^1)—C(=O)—O—(CH_2)_2—NH—(C=O)—NH—C_{18}H_{37}$

In the formulae, $R^1$ each independently at each occurrence represents a hydrogen atom or a $—CH_3$ group, and preferably a hydrogen atom.

The solution containing the compound (A) may contain 0.5 parts by mass or more of the compound (A) per 100 parts by mass of the solution, 1 part by mass or more of the compound (A), 20 parts by mass or less of the compound (A), or 10 parts by mass or less of the compound (A). For example, the solution containing the compound (A) may contain 0.5 to 20 parts by mass or 1 to 10 parts by mass of the compound (A) per 100 parts by mass of the solution. If the concentration of the compound (A) in the solution is too high, the viscosity of the solution is high, which may cause the solution to be unevenly distributed on the surface of the paper base. In such a case, the gaps of the paper are completely blocked, which may cause a decrease in air permeance of the paper. If the concentration of the compound (A) in the solution is too low, the fiber gaps of the surface of the paper cannot be filled, which may lead to a decrease in oil resistance on the surface of the paper.

The compound (A) may be a compound represented by the following formula.

$CH_2=C(—H)—C(=O)—O—R^2$

In the formula, $R^2$ is as described above.

In one embodiment, $R^2$ is more preferably an alkyl group having 14 to 28 carbon atoms, preferably an alkyl group having 14 to 26 carbon atoms, and still more preferably an alkyl group having 18 to 26 carbon atoms. By using such a compound, liquid repellency can be imparted to the paper to cause the paper to exhibit oil resistance.

The solution may further contain a solvent, a cross-linking agent, a pigment, a binder, starch, polyvinyl alcohol, and a paper strengthening agent and the like.

Examples of the solvent include, but are not limited to, water, acetone, methanol, ethanol, isopropanol, ethyl acetate, toluene, and tetrahydrofuran. By using such a solvent, the solution containing the compound (A) can be uniformly present on the surface of the paper base. Specifically, the solution containing the compound (A) can be uniformly coated on the paper base. The solvent may be used singly or in combination of two or more.

As the solvent, acetone, methanol, ethanol and the like are preferably used from the viewpoint of the ease of coating and solvent removal.

Water or a water-ethanol mixed solution is preferably used from the viewpoint of reducing an environmental load.

It is preferable that a component contained in the solution, for example, the compound (A) be uniformly present in the solution. The solution may be a liquid in which the component contained in the solution is dissolved, or a liquid in which the component contained in the solution is dispersed.

In a preferable embodiment, the solution consists of the compound (A) and the solvent. In the solution, the compound (A) and the solvent are preferably contained at a mass ratio of 0.5:99.5 to 20:80, and more preferably 1:99 to 10:90.

In one embodiment, the solution contains 5 to 20% by mass, and preferably 6 to 15% by mass of the compound (A). The present embodiment is advantageous for a method which allows a high concentration treatment such as a coating treatment using a gravure printing machine, for example.

In one embodiment, the compound (A) is used together with a cross-linking agent. In this embodiment, a paper having better oil resistance can be obtained. This is considered to be because the cross-linking agent can serve as a reaction auxiliary, and a structure derived from the cross-linking agent can be introduced as a flexible structure into the layer formed from the compound (A), as a result of which the layer is less likely to crack. For example, when a paper is folded, this effect is more beneficial.

The cross-linking agent can be contained within a range of 3 to 50% by mass based on the compound (A). For example, the cross-linking agent can be contained within a range of 10 to 45% by mass. In this embodiment, the compound (A) preferably has a carbon-carbon unsaturated bond in a molecular chain.

In another embodiment, the compound (A) and the cross-linking agent are preferably contained at a mass ratio of 90:10 to 70:30. If the content rate of the cross-linking agent is too high, a paper having good oil resistance may not be obtained.

Examples of the cross-linking agent include polyfunctional urethane acrylate, polyfunctional acryl amide, di(meth)acrylate (for example, glycerin di(meth)acrylate, polyethylene glycol di(meth)acrylate), tri(meth)acrylate (for example, trimethylolpropane triacrylate, pentaerythritol triacrylate), tetra(meth)acrylate (for example, pentaerythritol tetraacrylate), and polyfunctional epoxy (for example, 1,4-butanediol diglycidyl ether, 1,6-hexanediol diglycidyl ether, diethylene glycol diglycidyl ether, polyethylene glycol diglycidyl ether).

In one embodiment, the solution consists of the compound (A), the cross-linking agent, and the solvent.

In the present embodiment, the total amount of the compound (A) and the cross-linking agent in the solution is preferably within a range of 0.5 to 20% by mass, and more preferably within a range of 1 to 15% by mass.

For example, the solution may contain 0.5 to 11% by mass of the compound (A) and 0.1 to 4% by mass of the cross-linking agent, or 1 to 10% by mass of the compound (A) and 0.1 to 3% by mass of the cross-linking agent.

As described above, a paper obtained by introducing the layer formed from the compound (A) on the surface of the paper base is formed.

When the graft chains are introduced on the surface of the paper base by irradiation of at least one of the ionizing radiation and the plasma, the paper having the graft chains is produced. That is, in one embodiment, the method for producing a paper of the present disclosure is a method for producing a paper having graft chains including irradiating at least one of ionizing radiation and plasma to at least one of a paper base and a compound (A) to introduce a layer formed from the compound (A) on a surface of the paper base.

The paper of the present disclosure has a surface having good oil-repellency and water-repellency. The oil-repellency and the water-repellency can be evaluated by measuring a static contact angle on the surface, for example.

On the surface of the paper, the static contact angle of water is preferably 90 degrees or more, and more preferably 100 degrees or more.

The paper exhibits good oil resistance. Specifically, an organic compound is less likely to penetrate into the paper. For example, when the paper of the present disclosure is evaluated by a kit method, the evaluation of the paper is preferably 3 or more, and more preferably 4 or more. The kit method is a method for evaluating the oil resistance of the paper, and is a method in which a kit number test liquid obtained by mixing castor oil, toluene, and heptane at a predetermined ratio is added dropwise to a specimen, to visually investigate the presence or absence of the penetration. Specifically, the penetration is measured according to the TAPPI T-559 cm-02 method as the evaluation standard of TAPPI (The leading technical association for the world-wide pulp, paper, and converting industry).

The paper has good water-repellency or oil-repellency even at a folded section of the paper, whereby the penetration of the organic compound is less likely to occur. In the production method of the present disclosure, the compound (A) is considered to be polymerized into a polymer having a very high molecular weight by the irradiation of the ionizing radiation or the plasma. It is considered that the strength of the above-described polymer is good, and the polymer is less likely to break even at the folded section of the paper, whereby the paper can have good oil-repellency even at the above-described folded section.

The value of the air permeance of the paper is not extremely lowered as compared with the value of the air permeance of the paper base. For example, the value of the air permeance of the paper can be maintained at 1,000 seconds or less. The air permeance is preferably 1,000 seconds or less, more preferably 800 seconds or less, and still more preferably 650 seconds or less. In the present disclosure, it is considered that the graft chains containing the compound (A) are introduced on the paper base, and for example, the solution containing the compound (A) and the paper base are brought into contact with each other, specifically the solution is coated on the paper base, and then dried, whereby a paper can be obtained, in which the blocking degree on the surface of the paper is small, and the blocking of the gaps through which a gas permeates is reduced to have good air permeance. Such a paper can be particularly advantageously used in applications where the paper is required to have oil-repellency and air permeance within a suitable range as in a food case raw paper and an oil-resistant paper.

For example, the coating weight on the paper may be within a range of 0.5 to 30 g/m$^2$, may be within a range of 0.5 to 20 g/m$^2$, may be within a range of 1.0 to 15 g/m$^2$, or may be within a range of 1 to 10 g/m$^2$. The coating weight can be measured based on a difference of the decomposition temperatures of the compound (A) and of the paper base according to thermogravimetric analysis, or calculation of a coating rate based on weight measurement of coating–drying.

Since the compound (A) forming the graft chains contains no fluorine atom, the paper is advantageous for requests based on stricter environmental regulations.

In the present disclosure, the solution containing the compound (A) contains no polymerization initiator. Therefore, the paper of the present disclosure on which the graft chains have been introduced contains no impurities derived from the polymerization initiator.

The paper obtained by the production method of the present disclosure can be used for, for example, an oil-resistant paper, a paper used for food packaging applications, and a peel/release paper.

Next, the paper of the present disclosure will be described.

The paper of the present disclosure has a surface having a layer formed from a compound (A), and the compound (A) has a carbon-carbon unsaturated bond and contains no fluorine atom in a molecular structure. The paper base and the compound (A) are as described above.

The paper of the present disclosure preferably has, at least on its surface, graft chains having a constituent unit derived from the compound (A). The paper includes the paper base and the graft chains provided at least on the surface of the paper base and derived from the compound (A).

The paper of the present disclosure is preferably produced by the method for producing a paper of the present disclosure.

In one embodiment, the paper of the present disclosure is a paper in which the polymer derived from the compound (A) (for example, the graft chains having a constituent unit derived from the compound (A)) is introduced on the paper base by irradiating at least one of the ionizing radiation and the plasma to at least one of the paper base and the compound (A).

Example 1

The present disclosure will be more specifically described through the following Examples, but the present disclosure is not limited to these Examples. The terms "part" and "%" respectively mean "part by mass" and "% by mass" unless otherwise specified.

In the following Examples and Comparative Examples, the term "room temperature" means 25° C. In the following Examples and Comparative Examples, unless otherwise described, a solution which contained a compound having a carbon-carbon unsaturated bond or a ring-opening polymerizable cyclic ether, and containing no fluorine atom in a molecular structure was coated at room temperature.

[Evaluation]

Papers obtained in Examples, Comparative Examples, and Reference Examples were evaluated under the following conditions. Hereinafter, when a test sample had a surface on which graft chains were formed or a polymer layer was provided (hereinafter, may be referred to as external additive surface), physical properties of the surface were measured.

<Oil Resistance Test (Kit Test)>

Oil resistance was evaluated based on TAPPI T-559 cm-02. A specific evaluation method is as follows.

Test oils having degrees of oil resistance shown in Table 1 were prepared. The mixing ratio (volume ratio) of each of the test oils having the degrees of oil resistance is as described in Table 1. The degree of oil resistance has 12 stages from high surface tension to low surface tension. As the degree of oil resistance is higher, the oil resistance is higher.

Each of the test oils was added dropwise to a test sample. After 15 seconds from the addition of the test oil, the oil resistance of the test sample was determined based on the definition of the TAPPI test. Specifically, the test oil on the surface of the test sample was wiped off, and it was visually observed whether the front side appearance of the paper appeared wet because of the penetration of the oil. The degree of oil resistance of the test oil having the highest degree of oil resistance among the test oils which did not penetrate into the test sample was the result of the oil resistance test.

TABLE 1

| Degree of oil resistance | Castor oil | Toluene | Heptane |
|---|---|---|---|
| 1 | 100 | 0 | 0 |
| 2 | 90 | 5 | 5 |
| 3 | 80 | 10 | 10 |
| 4 | 70 | 15 | 15 |
| 5 | 60 | 20 | 20 |
| 6 | 50 | 25 | 25 |
| 7 | 40 | 30 | 30 |
| 8 | 30 | 35 | 35 |
| 9 | 20 | 40 | 40 |
| 10 | 10 | 45 | 45 |
| 11 | 0 | 50 | 50 |
| 12 | 0 | 45 | 55 |

The degree of oil resistance "0" in the Table representing the evaluation results means that the test oil penetrated into the test sample even when a test oil having the degree of oil resistance of 1 was used.

<Oil Resistance Test in Folded Portion (Kit Test)>

A "folded portion" was formed in a test sample according to the following steps (1) to (3). Oil resistance of the folded portion was evaluated according to the method described in the oil resistance test (Kit Test).

(1) The test sample was bent. When the test sample was each of samples obtained in Examples and Comparative Examples 1-1 to 1-3, the test sample was bent so that an external additive surface (a surface coated with a solution) thereof was located inside.

(2) A roll which was covered with a rubber layer having a weight of 250 g and a thickness of 0.6 cm and had a diameter of 8 cm and a width of 7 cm was rolled on the test sample bent in the step (1) to completely form a fold. The speed of the roll when the fold was formed was set to 50 to 60 cm/second.

(3) The fold of the test sample in which the fold had been formed in the step (2) was extended, and this was taken as the folded portion.

<Air Permeance>

Gurley air permeance was measured based on the method of JIS P8117.

<Measurement of Hexadecane (HD) Contact Angle, and Evaluation of Oil Resistance with Respect to HD>

A HD contact angle was measured by the following method.

A double-sided tape was attached to a surface located on an opposite side of an external additive surface of a test sample, to fix the test sample on a glass plate. 2 μl of HD was added dropwise to the surface, and after the lapse of 30 seconds, a contact angle was measured by using a contact angle measurement apparatus Dropmaster 701 (manufactured by Kyowa Interface Science Co., Ltd).

After the lapse of 7 minutes from the addition, the presence or absence of the penetration of the HD added dropwise to the test sample was visually confirmed. The oil resistance of the test sample with respect to the HD was determined based on the following criteria.

a: There is no change in color of the surface of the test sample due to the penetration of the HD after the HD is wiped off.

b: There is change in color of the surface of the test sample due to the penetration of the HD after the HD is wiped off.

<Evaluation of Water Absorptivity (Cobb Value)>

Water absorptivity (Cobb value) was measured according to JIS P 8140: 1998.

A paper base was placed on a smoothly finished surface of a hard base plate, and a metal cylinder having an inner diameter of 112.8 mm was fixed to the surface by a clamp. Then, water was poured so that a depth of water in the cylinder was set to 10 mm. A weight of water absorbed in 1 minute from the starting of the contact of the water with the paper base was determined. The obtained numerical value was converted into a weight per square meter ($g/m^2$), to determine water absorptivity (Cobb value).

<Measurement of Water Contact Angle>

A water contact angle was measured by the following method.

A double-sided tape was attached to a surface located on an opposite side of an external additive surface of a test sample, to fix the test sample on a glass plate, and 2 μl of water was added dropwise thereto to measure a contact angle after 1 second. The contact angle was measured under an atmosphere at 25° C. and 30 to 60% humidity using a contact angle measurement apparatus Dropmaster 701 (manufactured by Kyowa Interface Science Co., Ltd).

<Evaluation of Oil Resistance With Practical Oil>

Several drops of commercial olive oil (extra-virgin olive oil) were added dropwise to the surface (flat portion) of a test sample. After the lapse of 7 minutes, the olive oil was wiped off, and the penetration of the olive oil into the test sample was visually confirmed. The penetration was evaluated as follows.

a: The ratio of an area of a portion into which the olive oil penetrates to an area of a portion in contact with the olive oil added dropwise on the surface of the test sample is 5% or less.

b: The ratio of an area of a portion into which the olive oil penetrates to an area of a portion in contact with the olive oil added dropwise on the surface of the test sample is more than 5% and less than 70%.

c: The ratio of an area of a portion into which the olive oil penetrates to an area of a portion in contact with the olive oil added dropwise on the surface of the test sample is 70% or more.

(Synthetic Example 1) Solution Polymerization of Polystearylacrylate (PSTA (1))

PSTA (1) was synthesized as follows.

Into an eggplant flask, 11.5 g (0.035 mol) of stearylacrylate ($CH_2{=}CHC({=}O)\ OC_{18}H_{37}$, hereinafter may be described as "STA"), 50 ml of toluene, and 53 mg (0.32 mmol) of azoisobutyronitrile were placed, bubbled with nitrogen for 20 minutes, and then heated with stirring at 65° C. After 8 hours, the heating was stopped, and the reaction solution was concentrated, and then subjected to resedimentation in methanol, to obtain 10.5 g of polystearylacrylate (PSTA (1)).

(Synthetic Example 2) Electron Beam Polymerization of Polystearylacrylate (PSTA (2))

PSTA (2) was synthesized as follows.

STA was bubbled with nitrogen gas for 30 minutes to deoxygenate the STA. 10 cc of the deoxygenated STA was injected into a sheet-like case. A low energy electron beam was irradiated to the sheet-like case in the absence of oxygen at 25° C. using a low energy electron accelerator, to obtain a reaction solution containing a solid content. An accelerating voltage of 250 kV and an absorbed dose of 80 kGy were set as irradiation conditions. The reaction solution was subjected to resedimentation in acetone, to obtain polystearylacrylate (PSTA (2)).

Example 1-1

As a paper base 1, a commercial Japanese writing paper (LA5-3, manufactured by Kuretake Co., Ltd., basis weight: 35 $g/m^2$, air permeance: 2 seconds, thickness: 90 μm) was prepared. An acetone solution containing 5% by mass of STA was coated on the surface of the paper base using a bar coater having a gap of 0 mm, and an operation for air-drying was then repeated multiple times. Then, the obtained paper was placed into a sheet-like case, and vacuum-deaerated. A low energy electron beam was irradiated to the sheet-like case in the absence of oxygen at 25° C. using a low energy electron accelerator. An accelerating voltage of 250 kV and an absorbed dose of 80 kGy were set as irradiation conditions.

Example 1-2

Example 1-2 was carried out in the same manner as in Example 1-1 except that the coating weight of an acetone solution containing 5% by mass of STA was changed.

Example 1-3

Example 1-3 was carried out in the same manner as in Example 1-1 except that the coating weight of an acetone solution containing 5% by mass of STA was changed.

Example 1-4

Example 1-4 was carried out in the same manner as in Example 1-1 except that the coating weight of an acetone solution containing 5% by mass of STA was changed.

Comparative Example 1-1

STA was bubbled with nitrogen gas for 30 minutes to deoxygenate the STA. 10 cc of the deoxygenated STA was injected into a sheet-like case. A low energy electron beam was irradiated to the sheet-like case in the absence of oxygen at 25° C. using a low energy electron accelerator, to obtain an EB-PSTA polymer. An accelerating voltage of 250 kV and an absorbed dose of 75 kGy were set as irradiation conditions.

The obtained EB-PSTA polymer was dispersed in a concentration of 5% by mass in HFE7200.

As a paper base 1, a commercial Japanese writing paper (LA5-3, manufactured by Kuretake Co., Ltd., basis weight: 35 g/m$^2$, air permeance: 2 seconds/100 ml of air, thickness: 90 μm) was prepared as with Example 1-1. An HFE7200 solution of an EB-PStA polymer was coated once on the surface of the paper base by a bar coater having a gap of 0 mm, and air-dried.

Comparative Example 1-2

The PSTA (1) obtained in Synthetic Example 1 was dissolved in chloroform, to obtain a $CHCl_3$ solution containing 5% by mass of the PSTA (1).

As a paper base, a commercial Japanese writing paper (LA5-3, manufactured by Kuretake Co., Ltd., basis weight: 35 g/m$^2$, air permeance: 2 seconds/100 ml of air, thickness: 90 μm) was prepared as with Example 1-1. The obtained $CHCl_3$ solution containing the PSTA (1) was coated once on the surface of the paper base using a bar coater having a gap of 0 mm, and then air-dried.

Comparative Example 1-3

Chloroform was added to the PSTA (2) obtained in Synthetic Example 2 to adjust the concentration of the PSTA (2), thereby obtaining a $CHCl_3$ solution containing 1% by mass of the PSTA (2).

As a paper base, a commercial Japanese writing paper (LA5-3, manufactured by Kuretake Co., Ltd., basis weight: 35 g/m$^2$, air permeance: 2 seconds/100 ml of air, thickness: 90 μm) was prepared as in Example 1-1. The obtained $CHCl_3$ solution in which the PSTA (2) was dissolved was coated once on one principal surface of the paper base using a bar coater having a gap of 0 mm, and then air-dried.

The polymerization conditions of Examples 1-1 to 1-4 and Comparative Examples 1-1 to 1-3 are shown in the following Table 2. In the following Table, "-" indicates that the electron beam was not irradiated to the paper base.

TABLE 2

| | Paper base | | | Treatment solution | | | Electron beam |
|---|---|---|---|---|---|---|---|
| Example No. | Basis weight g/m$^2$ | Air permeance Second | Thickness μm | Chemical agent for treatment — | Concentration wt.% | Solvent — | Absorbed dose kGy |
| Example 1-1 | 35 | 2 | 90 | STA | 5 | Acetone | 80 |
| Example 1-2 | 35 | 2 | 90 | STA | 5 | Acetone | 80 |
| Example 1-3 | 35 | 2 | 90 | STA | 5 | Acetone | 80 |
| Example 1-4 | 35 | 2 | 90 | STA | 5 | Acetone | 80 |
| Comparative Example 1-1 | 35 | 2 | 90 | EB-PSTA | 5 | HFE7200 (dispersion) | — |
| Comparative Example 1-2 | 35 | 2 | 90 | PSTA(1) | 5 | $CHCl_3$ | — |
| Comparative Example 1-3 | 35 | 2 | 90 | PSTA(2) | 1 | $CHCl_3$ | — |

The physical properties of the papers obtained in Examples 1-1 to 1-4 and Comparative Examples 1-1 to 1-3 are shown in the following Table 3. In the following Table, "-" indicates no measurement.

The "coating weight" is a value determined as follows.

The coating weight can be calculated by cutting out the paper of 1.5 cm×2.5 cm, drying the cut-out paper for 30 minutes under a vacuum condition at 100° C., measuring the weight of the dried paper, and comparing the weight of the paper with a dry weight of a paper base similarly measured.

TABLE 3

| | | KIT | | Evaluation of oil resistance | | Contact |
|---|---|---|---|---|---|---|
| | Coating weight g/m$^2$ | Flat portion — | Folded portion — | Practical oil (olive oil) — | Air permeance Second | angle Water Degree |
| Example 1-1 | 10.9 | 4 | 2 | a | 8 | 108.5 |
| Example 1-2 | 10.5 | 3 | 2 | b | 6 | — |
| Example 1-3 | 20.8 | 3-4 | 2 | b | 11 | — |
| Example 1-4 | 3.7 | 4 | 2 | a | 4 | — |
| Comparative Example 1-1 | 5.4 | 0 | 0 | c | — | 57.9 |

TABLE 3-continued

| | | KIT | | Evaluation of oil resistance | | Contact |
|---|---|---|---|---|---|---|
| | Coating weight g/m$^2$ | Flat portion — | Folded portion — | Practical oil (olive oil) — | Air permeance Second | angle Water Degree |
| Comparative Example 1-2 | — | 4 | 0-1 | a | — | 128.8 |
| Comparative Example 1-3 | — | 4-5 | 0 | a | 1022 | 113.2 |

Example 2-1

Example 2-1 was carried out in the same manner as in Example 1-4 except that the absorbed dose of a low energy electron beam provided by a low energy electron accelerator was set to 120 kGy.

The conditions of Example 2-1 are shown in the following Table 4, and the evaluation results of Example 2-1 are shown in Table 5. Each evaluation was carried out as described above. The results of Example 1-4 are repeated as reference.

TABLE 4

| | Paper base | | | Treatment solution | | | Electron beam |
|---|---|---|---|---|---|---|---|
| Example No. | Basis weight g/m$^2$ | Air permeance Second | Thickness μm | Chemical agent for treatment — | Concentration wt.% | Solvent — | Absorbed dose kGy |
| Example 2-1 | 35 | 2 | 90 | STA | 5 | Acetone | 120 |
| Example 1-4 | 35 | 2 | 90 | STA | 5 | Acetone | 80 |

TABLE 5

| | | KIT | | Evaluation of oil resistance | |
|---|---|---|---|---|---|
| | Coating weight g/m$^2$ | Flat portion — | Folded portion — | Practical oil (olive oil) — | Air permeance Second |
| Example 2-1 | 3.2 | 3 | 2 | b | 2 |
| Example 1-4 | 3.7 | 4 | 2 | a | 4 |

Comparative Example 3

Comparative Example 3 was carried out in the same manner as in Example 1-4 except that an acetone solution containing 5% by mass of dodecylacrylate ($CH_2$=CHC(=O) $OC_{12}H_{25}$) was used in place of an acetone solution containing 5% by mass of STA, and the absorbed dose of a low energy electron beam was set to 60 kGy.

Example 3

Example 3 was carried out in the same manner as in Example 1-3 except that docosyl acrylate ($CH_2$=CHC(=O)$OC_{22}H_{45}$) was used in place of dodecylacrylate, and the absorbed dose of an electron beam was set to 75 kGy. The evaluation of the oil resistance on the surface of the paper obtained in Example 3 with respect to HD was a.

The conditions of Example 3 and Comparative Example 3 are shown in the following Table 6, and the evaluation results of Example 3 and Comparative Example 3 are shown in Table 7. Each evaluation was carried out as described above.

TABLE 6

| | Treatment solution | | | Electron beam |
|---|---|---|---|---|
| | Chemical agent for treatment | Concentration [wt %] | Solvent | Absorbed dose [kGy] |
| Comparative Example 3 | Dodecyl acrylate | 5 | Acetone | 60 |
| Example 3 | Docosyl acrylate | 5 | Acetone | 75 |

TABLE 7

| | Coating weight g/m² | KIT Flat portion — | KIT Folded portion — | Evaluation of oil resistance Practical oil (olive oil) — | Air permeance Second | Contact angle Water Degree |
|---|---|---|---|---|---|---|
| Comparative Example 3 | 12.0 | 1 | 0 | b | | 62.3 |
| Example 3 | 13.1 | 3-4 | — | a | 6 | 110.5 |

Comparative Example 2-1

An oil-resistant paper 50NFB manufactured by Nippon Paper Papylia Co., Ltd. (basis weight: 50 g/m², thickness: 52 μm) as Comparative Example 2-1 was subjected to a test. The evaluation of the oil resistance on the surface of the paper of Comparative Example 2-1 with respect to HD was a.

Comparative Example 2-2

An OWB sheet manufactured by LINTEC Corporation (basis weight: 45 g/m², thickness: 49 μm) was subjected to a test. The evaluation of the oil resistance on the surface of the paper of Comparative Example 2-2 with respect to HD was b.

The evaluation results of the physical properties of Comparative Examples are shown in the following Table.

TABLE 8

| | Basis weight g/m² | Thickness μm | Contact angle HD Degree | KIT Surface — | KIT Fold — | Evaluation of oil resistance Practical oil (olive oil) — | Air permeance Second | Contact angle Water Degree |
|---|---|---|---|---|---|---|---|---|
| Comparative Example 2-1 | 50 | 52 | 0 | 7 | 0-1 | b | >15000 | 86.7 |
| Comparative Example 2-2 | 45 | 49 | 0 | 1-2 | 0 | c | 3500 | 100.3 |

The following paper was used as a paper base 2.

A pulp slurry was prepared, in which the weight ratios of LBKP (leaf bleached kraft pulp) and NBKP (needle bleached kraft pulp) used as wood pulp were 60% by weight and 40% by weight, and the freeness of the pulp was 400 ml (Canadian Standard Freeness). A wet paper strengthener and a size agent were added to the pulp slurry. Then, a paper having a paper density of 0.58 g/cm³ and a basis weight of 45 g/m² was prepared by using a fourdrinier machine.

The oil resistance (KIT value) of the paper base 2 was 0, and the water resistance (Cobb value) was 52 g/m².

Example 4-1

Example 4-1 was carried out in the same manner as in Example 1-4 except that a paper base 2 was used as a paper base. The evaluation of the oil resistance on the surface of the paper obtained in Example 4-1 with respect to HD was a.

Example 4-2

Example 4-2 was carried out in the same manner as in Example 4-1 except that an acetone solution containing 4% by mass of STA and 1% by mass of urethane acrylate UA-160™ (manufactured by Shin-Nakamura chemical Co., Ltd.) was used in place of an acetone solution containing 5% by mass of STA. The evaluation of the oil resistance on the surface of the paper obtained in Example 4-2 with respect to HD was a.

Example 4-3

Example 4-3 was carried out in the same manner as in Example 4-1 except that a toluene solution containing 1.7% by mass of stearyl acid amide ethyl acrylate (C18AmEA) was used in place of an acetone solution containing 5% by mass of STA, to apply the toluene solution multiple times; the absorbed dose of an electron beam was set to 100 kGy; and an atmospheric temperature during the irradiation of the electron beam was set to 100° C. The evaluation of the oil resistance on the surface of the paper obtained in Example 4-3 with respect to HD was a.

Example 4-4

Example 4-4 was carried out in the same manner as in Example 4-3 except that a toluene solution containing 1.36% by mass of C18AmEA and 0.34% by mass of PEG200 dimethacrylate (PEGdMA) was used in place of a toluene solution containing 1.7% by mass of C18AmEA. The evaluation of the oil resistance on the surface of the paper obtained in Example 4-4 with respect to HD was a.

The treatment conditions of Examples 4-1 to 4-4 are shown in the following Table 9. The physical properties of the papers obtained in Examples 4-1 to 4-4 are shown in Table 10.

TABLE 9

| Example No. | Paper base: Basis weight g/m² | Paper base: Air permeance Second | Treatment solution: Chemical agent for treatment — | Treatment solution: Concentration wt.% | Treatment solution: Solvent — | Electron beam: Absorbed dose kGy | Electron beam: Application temperature ° C. |
|---|---|---|---|---|---|---|---|
| Example 4-1 | 45 | 132 | STA | 5 | Acetone | 80 | 25 |
| Example 4-2 | 45 | 132 | STA | 4 | Acetone | 80 | 25 |
| | | | UA-160TM | 1 | | | |
| Example 4-3 | 45 | 132 | C18AmEA | 1.7 | Toluene | 100 | 100 |
| Example 4-4 | 45 | 132 | C18AmEA | 1.36 | Toluene | 100 | 100 |
| | | | PEGdMA | 0.34 | | | |

TABLE 10

| | Coating weight g/m² | KIT: Flat portion — | KIT: Folded portion — | Evaluation of oil resistance: Practical oil (olive oil) — | Air permeance Second | Contact angle Water Degree |
|---|---|---|---|---|---|---|
| Example 4-1 | 10.1 | 5 | 3-4 | a | 352 | — |
| Example 4-2 | 11.4 | 5 | 4 | a | 423 | — |
| Example 4-3 | 8.4 | 3-4 | 2 | b | 183 | — |
| Example 4-4 | 8.5 | 5 | 4 | a | 191 | 112 |

Example 5-1

A cardboard was used as a paper base, and an acetone solution containing 5% by mass of STA was dip-coated on the cardboard multiple times. A low energy electron beam was irradiated at an absorbed dose of 100 kGy to the cardboard at 25° C. The coating weight of the paper obtained in Example 5-1 was 25 g/m², and the evaluation of the oil resistance on the surface of the coated paper with respect to HD was a.

Example 6-1

An acetone solution containing 12% by mass of STA and 3% by mass of PEGdMA was coated by a gravure printing machine provided with a gravure plate having a plate depth of 30 μm. The acetone solution was coated on a paper base 1 at a printing speed of 33 m/s, and dried by hot air. Then, a low energy electron beam was irradiated to the obtained paper using a low energy electron accelerator. An accelerating voltage of 250 kV, an absorbed dose of 80 kGy, a temperature of 25° C., and an oxygen concentration of 100 ppm were set as irradiation conditions. The evaluation of the oil resistance on the surface of the paper obtained in Example 6-1 with respect to HD was a.

TABLE 11

| | Coating weight g/m² | KIT: Flat portion — | KIT: Folded portion — | Evaluation of oil resistance: Practical oil (olive oil) — | Air permeance Second | Contact angle Water Degree |
|---|---|---|---|---|---|---|
| Example 6-1 | 4.3 | 5 | 4 | a | 312 | — |

Examined Example 1

The paper obtained in Example 1-1 was stirred in chloroform overnight, and then air-dried. The air-dried paper was subjected to oil resistance evaluation with practical oil using olive oil. The result was a.

Examined Example 2

The paper obtained in Comparative Example 1-2 was stirred in chloroform overnight, and then air-dried. The air-dried paper was subjected to oil resistance evaluation with practical oil using olive oil. The result was c.

The present disclosure provides the following [1] to [17].

[1] A method for producing a paper, wherein the method includes applying at least one of ionizing radiation and plasma to at least one of a paper base and a compound (A) selected from:

a compound having a carbon-carbon unsaturated bond and containing no fluorine atom in a molecular structure, and a compound containing no fluorine atom in a molecular structure in which radicals are generated by irradiation of an electron beam to the compound, to introduce a layer formed from the compound (A) on a surface of the paper base, wherein the compound (A) is at least one of compounds represented by the following formulae:

$R^1(—R^{21}—)_m—R^1$ $CH_2=C(—R^1)—C(=O)—O—R^2$, $CH_2=C(—R^1)—C(=O)—O—(CH_2)_m—OC(=O)—NH—R^2$, $CH_2=C(—R^1)—C(=O)—O—(CH_2)_m—NH—C(=O)—R^3$, $CH_2=C(—R^1)—C(=O)—O—(CH_2)_m—NH—C(=O)—NH—R^2$, $CH_2=C(—R^1)—C(=O)—O—(CH_2)_m—NH—SO_2—R^2$, $CH_2=C(—R^1)—C(=O)—O—R^4—C_6H_4—O—R^2$, $CH_2=C(—R^1)—C(=O)—O—(CH_2CH_2O)_n—R^2$ wherein:

$R^1$ is each independently at each occurrence a hydrogen atom, a $—CH_3$ group, or a chlorine atom;

$R^{21}$ is an alkylene group having 14 to 28 carbon atoms;

$R^2$ is each independently at each occurrence an alkyl group having 14 to 28 carbon atoms;

$R^3$ is each independently at each occurrence an alkyl group having 13 to 27 carbon atoms;

$R^4$ is each independently at each occurrence a single bond or an alkylene group having 1 to 20 carbon atoms;

m is an integer of 1 to 28; and n is an integer of 1 to 3.

[2] The method according to [1], wherein the compound (A) is present at least on the surface of the paper base.

[3] The method according to [1] or [2], wherein $R^2$ is an alkyl group having 16 to 27 carbon atoms.

[4] The method according to any one of [1] to [3], wherein $R^3$ is an alkyl group having 15 to 26 carbon atoms.

[5] The method according to any one of [1] to [4], further including bringing a solution containing the compound (A) and the paper base into contact with each other.

[6] The method according to [5], wherein the contact is provided by coating or spraying the solution containing the compound (A) on the paper base, or immersing the paper base in the solution containing the compound (A).

[7] The method according to [5] or [6], wherein the solution further contains a solvent.

[8] The method according to any one of [5] to [7], wherein the solution contains 0.5 to 20 parts by mass of the compound (A) per 100 parts by mass of the solution.

[9] The method according to any one of [1] to [8], wherein irradiation of the at least one of the ionizing radiation or the plasma is irradiation of the ionizing radiation.

[10] The method according to [9], wherein an absorbed dose of the ionizing radiation is 5 to 250 kGy.

[11] The method according to any one of [1] to [8], wherein irradiation of at least one of the ionizing radiation or the plasma is irradiation of at least one of an α-ray, an electron beam, a γ-ray, a neutron ray, an X-ray, and plasma.

[12] The method according to [11], wherein irradiation of the at least one of the ionizing radiation or the plasma is irradiation of at least one of an electron beam and plasma.

[13] A paper including a layer formed on a surface thereon, wherein the layer is formed from a compound (A) selected from:

a compound having a carbon-carbon unsaturated bond and containing no fluorine atom in a molecular structure, and a compound containing no fluorine atom in a molecular structure in which radicals are generated by irradiation of an electron beam to the compound, and the compound (A) is at least one of compounds represented by the following formulae:

$R^1(—R^{21}—)_m—R^1$ $CH_2=C(—R^1)—C(=O)—O—R^2$, $CH_2=C(—R^1)—C(=O)—O—(CH_2)_m—OC(=O)—NH—R^2$, $CH_2=C(—R^1)—C(=O)—O—(CH_2)_m—NH—C(=O)—R^3$, $CH_2=C(—R^1)—C(=O)—O—(CH_2)_m—NH—C(=O)—NH—R^2$, $CH_2=C(—R^1)—C(=O)—O—(CH_2)_m—NH—SO_2—R^2$, $CH_2=C(—R^1)—C(=O)—O—R^4—C_6H_4—O—R^2$, $CH_2=C(—R^1)—C(=O)—O—(CH_2CH_2O)_n—R^2$ wherein:

$R^1$ is each independently at each occurrence a hydrogen atom, a $—CH_3$ group, or a chlorine atom;

$R^{21}$ is an alkylene group having 14 to 28 carbon atoms;

$R^2$ is each independently at each occurrence an alkyl group having 14 to 28 carbon atoms;

$R^3$ is each independently at each occurrence an alkyl group having 13 to 27 carbon atoms;

$R^4$ is each independently at each occurrence a single bond or an alkylene group having 1 to 20 carbon atoms;

m is an integer of 1 to 28; and n is an integer of 1 to 3.

[14] The paper according to [13], wherein $R^2$ is an alkyl group having 16 to 27 carbon atoms.

[15] The paper according to [13] or [14], wherein $R^3$ is an alkyl group having 15 to 26 carbon atoms.

[16] The paper according to any one of [13] to [15], wherein the paper is an oil-resistant paper.

[17] The paper according to any one of [13] to [16], wherein the paper is a paper used for food packaging applications.

INDUSTRIAL APPLICABILITY

The paper obtained by the production method of the present disclosure can be used for, for example, a paper used for food packaging applications, a peel/release paper, and an oil-resistant paper.

The invention claimed is:

1. A method for producing a paper, wherein the method comprises applying at least one of ionizing radiation and plasma to at least one of a paper base and a compound (A) selected from:

a compound having a carbon-carbon unsaturated bond and containing no fluorine atom in a molecular structure, to introduce a layer formed from a graft polymer consisting of the compound (A) on a surface of the paper base, wherein the compound (A) is at least one of compounds represented by the following formulae:

$CH_2=C(-R^1)—C(=O)—O—R^2$, $CH_2=C(-R^1)—C(=O)—O—(CH_2)_m—OC(=O)—NH—R^2$, $CH_2=C(-R^1)—C(=O)—O—(CH_2)_m—NH—C(=O)—R^3$, $CH_2=C(-R^1)—C(=O)—O—(CH_2)_m—NH—C(=O)—NH—R^2$, $CH_2=C(-R^1)—C(=O)—O—(CH_2)_m—NH—SO_2—R^2$, $CH_2=C(-R^1)—C(=O)—O—R^4—C_6H_4—O—R^2$, $CH_2=C(-R^1)—C(=O)—O—(CH_2CH_2O)_n—R^2$ wherein:

$R^1$ is each independently at each occurrence a hydrogen atom, a $—CH_3$ group, or a chlorine atom;

$R^2$ is each independently at each occurrence an alkyl group having 14 to 28 carbon atoms;

$R^3$ is each independently at each occurrence an alkyl group having 13 to 27 carbon atoms;

$R^4$ is each independently at each occurrence a single bond or an alkylene group having 1 to 20 carbon atoms;

m is an integer of 1 to 28; and n is an integer of 1 to 3.

2. The method according to claim 1, wherein the compound (A) is present at least on the surface of the paper base.

3. The method according to claim 1, wherein $R^2$ is an alkyl group having 16 to 27 carbon atoms.

4. The method according to claim 1, wherein $R^3$ is an alkyl group having 15 to 26 carbon atoms.

5. The method according to claim 1, further comprising bringing a solution containing the compound (A) and the paper base into contact with each other.

6. The method according to claim 5, wherein the contact is provided by coating or spraying the solution containing the compound (A) on the paper base, or immersing the paper base in the solution containing the compound (A).

7. The method according to claim 5, wherein the solution further contains a solvent.

8. The method according to claim 5, wherein the solution contains 0.5 to 20 parts by mass of the compound (A) per 100 parts by mass of the solution.

9. The method according to claim 1, wherein irradiation of the at least one of the ionizing radiation or the plasma is irradiation of the ionizing radiation.

10. The method according to claim 9, wherein an absorbed dose of the ionizing radiation is 5 to 250 kGy.

11. The method according to claim 1, wherein irradiation of at least one of the ionizing radiation or the plasma is irradiation of at least one of an α-ray, an electron beam, a γ-ray, a neutron ray, an X-ray, and plasma.

12. The method according to claim 11, wherein irradiation of the at least one of the ionizing radiation or the plasma is irradiation of at least one of an electron beam and plasma.

13. A paper comprising a layer formed on a surface thereon, wherein the layer comprises a graft chain formed from a compound (A) selected from:

a compound having a carbon-carbon unsaturated bond and containing no fluorine atom in a molecular structure, and the compound (A) is at least one of compounds represented by the following formulae:

$CH_2=C(-R^1)—C(=O)—O—R^2$, $CH_2=C(-R^1)—C(=O)—O—(CH_2)_m—OC(=O)—NH—R^2$, $CH_2=C(-R^1)—C(=O)—O—(CH_2)_m—NH—C(=O)—R^3$, $CH_2=C(-R^1)—C(=O)—O—(CH_2)_m—NH—C(=O)—NH—R^2$, $CH_2=C(-R^1)—C(=O)—O—(CH_2)_m—NH—SO_2—R^2$, $CH_2=C(-R^1)—C(=O)—O—R^4—C_6H_4—O—R^2$, $CH_2=C(-R^1)—C(=O)—O—(CH_2CH_2O)_n—R^2$ wherein:

$R^1$ is each independently at each occurrence a hydrogen atom, a $—CH_3$ group, or a chlorine atom;

$R^2$ is each independently at each occurrence an alkyl group having 14 to 28 carbon atoms;

$R^3$ is each independently at each occurrence an alkyl group having 13 to 27 carbon atoms;

$R^4$ is each independently at each occurrence a single bond or an alkylene group having 1 to 20 carbon atoms;

m is an integer of 1 to 28; and n is an integer of 1 to 3.

14. The paper according to claim 13, wherein $R^2$ is an alkyl group having 16 to 27 carbon atoms.

15. The paper according to claim 13, wherein $R^3$ is an alkyl group having 15 to 26 carbon atoms.

16. The paper according to claim 13, wherein the paper is an oil-resistant paper.

17. The paper according to claim 13, wherein the paper is a paper used for food packaging applications.

* * * * *